US008132518B2

(12) United States Patent
Kim et al.

(10) Patent No.: US 8,132,518 B2
(45) Date of Patent: Mar. 13, 2012

(54) SUBSTANTIALLY LINEAR VERTICAL LIFT SYSTEM

(75) Inventors: Han-su Kim, Seoul (KR); Kyung-dong Lee, Gyeongggi-do (KR); Chang-hoon Baek, Gyeonggi-do (KR)

(73) Assignee: Siemens Medical Solutions USA, Inc., Malvern, PA (US)

( * ) Notice: Subject to any disclaimer, the term of this patent is extended or adjusted under 35 U.S.C. 154(b) by 1341 days.

(21) Appl. No.: 11/801,968

(22) Filed: May 11, 2007

(65) Prior Publication Data

US 2008/0277205 A1 Nov. 13, 2008

(51) Int. Cl.
*A47B 9/00* (2006.01)

(52) U.S. Cl. ..... 108/145; 248/421; 248/562; 254/122

(58) Field of Classification Search ..... 108/144.11, 108/145; 248/421, 588, 585; 254/122; 182/69, 182/148, 69.1, 481
See application file for complete search history.

(56) References Cited

U.S. PATENT DOCUMENTS

| | | | | | |
|---|---|---|---|---|---|
| 913,049 | A | * | 2/1909 | Pieper | 248/585 |
| 2,949,153 | A | * | 8/1960 | Hickman | 248/585 |
| 3,215,386 | A | * | 11/1965 | Swenson | 248/566 |
| 3,596,982 | A | * | 8/1971 | Grams | 297/344.17 |
| 5,004,206 | A | * | 4/1991 | Anderson | 248/585 |
| 5,025,600 | A | * | 6/1991 | Sugimoto et al. | 248/588 |
| 5,129,397 | A | | 7/1992 | Jingu et al. | |
| 5,542,638 | A | * | 8/1996 | Smith | 248/421 |
| 5,924,988 | A | | 7/1999 | Burris et al. | |
| 6,029,585 | A | * | 2/2000 | Tabayashi | 108/145 |
| 6,038,986 | A | * | 3/2000 | Ransil et al. | 108/145 |
| 6,155,642 | A | * | 12/2000 | Kawakami et al. | 248/421 |
| 6,354,556 | B1 | * | 3/2002 | Ritchie et al. | 248/562 |
| 7,134,721 | B2 | * | 11/2006 | Robinson | 297/284.3 |
| 7,222,832 | B2 | * | 5/2007 | Welker | 248/421 |

OTHER PUBLICATIONS

Design of Machinery—An Introduction to the Synthesis and Analysis of Mechanisms and Machines by: Robert L. Norton, Copyright 1992. Publisher: McGraw-Hill Inc. Printed in Singapore.
Eccocee Overview, Toshiba Technology, obtained at internet address http://www.toshiba.com/tams/newtams/us/ecoc1.html, Jan. 31, 2000.
Esaote, The Image of Innovation, obtained at internet address http://www.esaote.com/technos.htm, Jan. 31, 2000.
Aloka Products SSD-1000, obtained at internet address http://www.aloka.com/english/products/ultrasonic/ssd1000.html, Jan. 31, 2000.
Siemens Ultrasound Group—SONOLINE Adara, obtained at internet address http://www.siemensultrasound.com/prod/adara/main.html, pp. 1-2, Jan. 31, 2000.
Siemens Ultrasound Group—SONOLINE Elegra, obtained at internet address http://www.siemensultrasound.com/prod/elegra/main.html, pp. 1-3, Jan. 31, 2000.
Siemens advertisement for SONOLINE Prima (The Small Giant), SONOLINE Versa Pro (Symbol of Value & Versatility) and SONOLINE Elegra (The Ultimate in Imaging Systems).
Toshiba Capassee global imaging medical system spec sheet.
Technos ultrasound system specifications.
Toshiba Eccocee "Makes You Turn to Color" brochure, Toshiba Corporation Medical Systems Division ©Toshiba Corporation 1994.
Zero Risk Technology™ Acoustic Imaging, A1 5200 Ultrasound Imaging System brochure.
Philips Medizen Systeme, Platinum brochure.

* cited by examiner

*Primary Examiner* — Jose V Chen

(57) ABSTRACT

A substantially vertical lift system is disclosed herein. The substantially vertical lift system is comprised of a platform, base, and a lifting mechanism. The lifting mechanism is designed to displace the platform in a substantially linear manner, and if desired, in a position parallel to the base. Multiple lifting mechanisms may be used, and displaced either in a side-by-side or stacked orientation. The configuration of the lifting mechanism is implementation dependent.

16 Claims, 8 Drawing Sheets

POSITION A

POSITION B

POSITION C

POSITION A

POSITION B

POSITION C

SUBSTANTIALLY LINEAR VERTICAL LIFT SYSTEM

BACKGROUND OF THE INVENTION

Lift device systems may be used for various applications in the automotive, machine, medical, and home electrical industries. Lift device systems are typically attached to an apparatus to allow for displacement in the horizontal direction, vertical direction, or a combination thereof. Lift device systems are typically comprised of rotating and/or slidable members and may be user or mechanically actuated, depending on the type of application.

Some applications require the lift device systems to displace the apparatus from a first position to a second position, where the second position is displaced along only one axis with respect to the first position. Lift mechanisms of the device systems designed to actuate the apparatus in such a manner travel along a single axis or along an arcuate path. Some lift device systems, which travel solely along a single axis, may require a portion of the lifting mechanism to be implemented above the platform or below the base. FIG. 1 shows an exemplary lift device system 100, similar to that of a car jack, which includes a lifting mechanism 102 comprising of a set of shafts 106 coupled to a base 110 via a set of linear bearings 108. As shown in FIG. 1, the lift device system 100 requires a portion of the set of shafts 106 of the lifting mechanism 102 to be disposed above the platform 104 that is to be lifted. The linear bearings 108 are designed to allow the platform 104 to travel along the shafts. Because the shafts 106 of the lifting mechanism 102 are fixed and a portion of the shafts 106 will remain disposed above the platform 104 when the platform 104 is not at its maximum height, the lifting mechanism 102 is not very compact.

FIG. 10 is an example of where a portion of a lift device system 320 is disposed below a base 326. The lifting mechanism 322 comprises a platform 324 that is coupled to a shaft 328 that is reciprocally coupled to a hollow cylinder 330. This embodiment is commonly used for hydraulic car lifts. The base 326 supports the hollow cylinder 330 as the shaft 324 travels in an axial manner. As shown in FIG. 10, a portion of the lifting mechanism 322, namely the hollow cylinder 330, is disposed below the base 326 during operation. As a result, this configuration requires a large amount of area below the lifting mechanism 322 and is difficult reposition or relocate.

Another example of a lift device system is shown in FIG. 2. The lift device system 200 comprises a lifting mechanism 202 coupled with a platform 204 and a base 206. The lifting mechanism 202 is comprised of a first member 208 having first 210 and second 212 ends, and a second member 214, having first 216 and second 218 ends. The first member 208 is pivotally coupled with the second member 214 at a substantially central point 224 along both members 208, 214. The first end 210 of the first member 208 is pivotally coupled with the platform 204. The first end 216 of the second member 214 is pivotally coupled to the base 206. The second ends 212, 218 of the first 208 and second 214 members incorporate sliding joints 220, 222 that travel along the base 206 and platform 204, respectively, as the platform 204 moves vertically. As can be seen in the figure, in this system, the vertical displacement of the platform 204 is limited to the horizontal length over which the sliding joints 220, 222 may travel, i.e. the length of the base 206 and platform 204.

Other lift device systems have lifting mechanisms that travel in an arcuate motion. Such an example is illustrated in FIG. 3, and depicts a lifting device 300 having a lifting mechanism 302 coupled with a platform 304 and a base 306.

The lifting mechanism 302 comprises a first member 308 having first 310 and second 312 ends, and a second member 314 having a first 316 and second 318 ends. The first ends 310, 316 of the first 308 and second 314 members are pivotally coupled with the platform 304. The second ends 312, 318 of the first 308 and second 314 members are pivotally coupled with the base 306. In operation, the first ends 310, 316 of the first 308 and second 314 members, and therefore the platform 304, travel along an arcuate path to displace the platform 304 to a position parallel to the base 306. The arcuate path of travel of the first 308 and second 314 members require a portion of the lifting mechanism 302 to extend beyond the platform 304 which demands more area during operation than other lift device systems.

Accordingly, there is a need for a lift device system, which is compact and is capable of linearly displacing a platform independent of the length of the apparatus or platform.

DETAILED DESCRIPTION OF THE PRESENTLY PREFERRED EMBODIMENTS

By way of introduction, one embodiment of a lift device system comprises a platform, a base, and a lifting mechanism. The lifting mechanism is pivotally coupled with the platform and the base and has a first, second, and connecting member, where the connecting member constrains the range of motion of the first and second members so as to actuate the platform in a linear manner.

Figure 1:
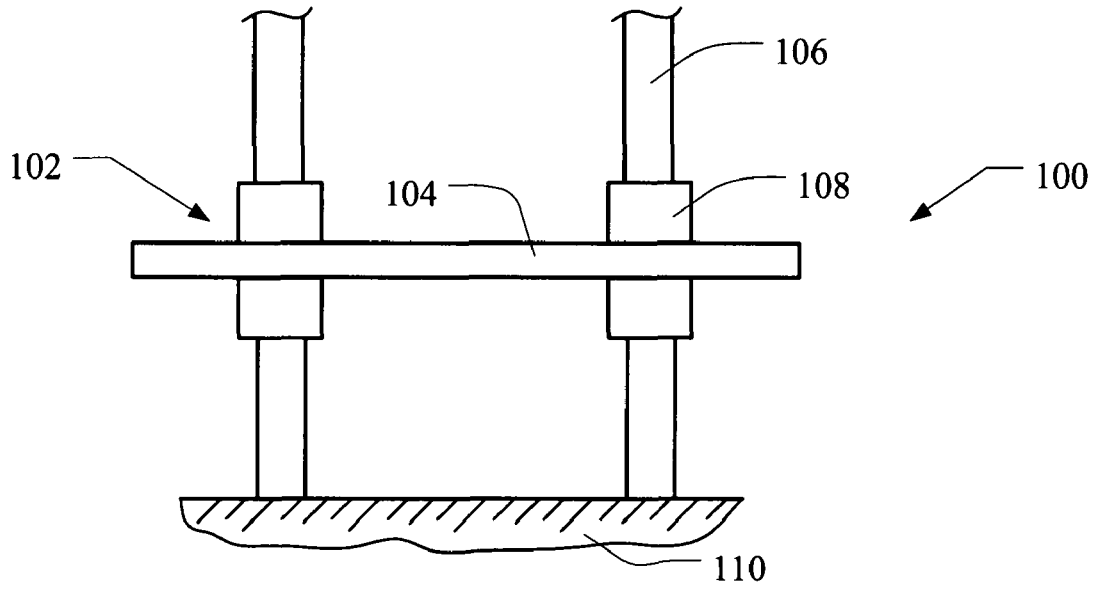
FIG. 1 (Prior Art)
FIG. 1 is a perspective view of a conventional lift device system.
Figure 2:
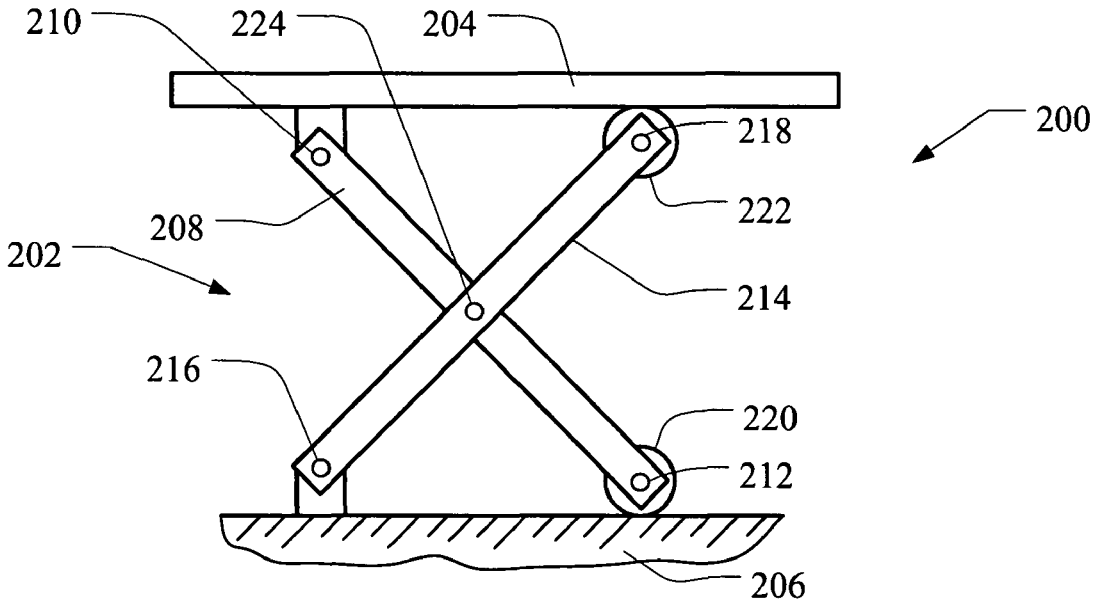
FIG. 2 (Prior Art)
FIG. 2 is a perspective of another conventional lift device system.
Figure 3:
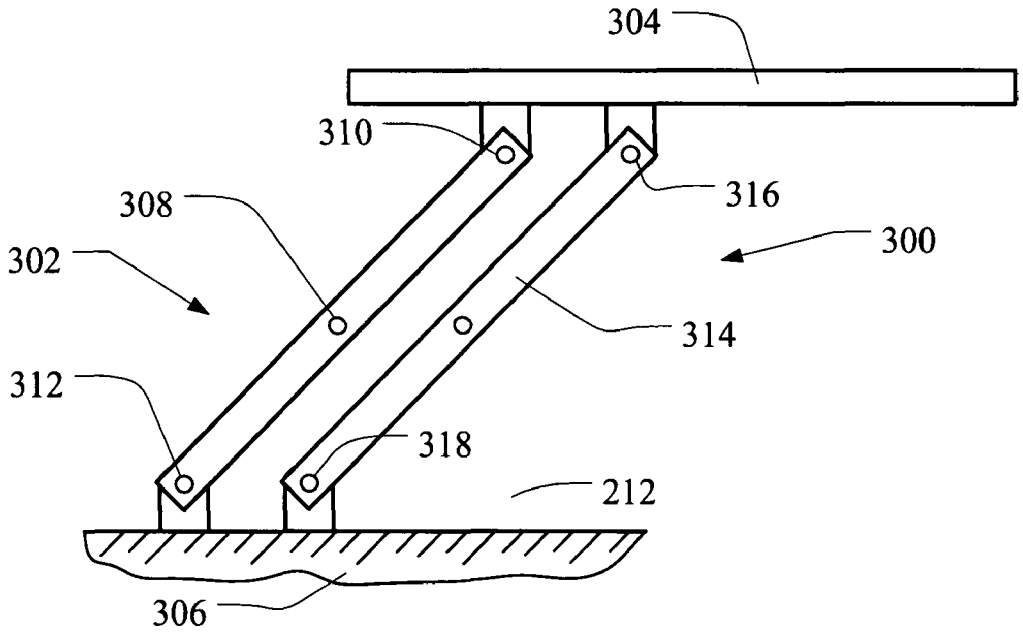
FIG. 3 (Prior Art)
FIG. 3 is a perspective view of yet another conventional lift device system.
Figure 4:
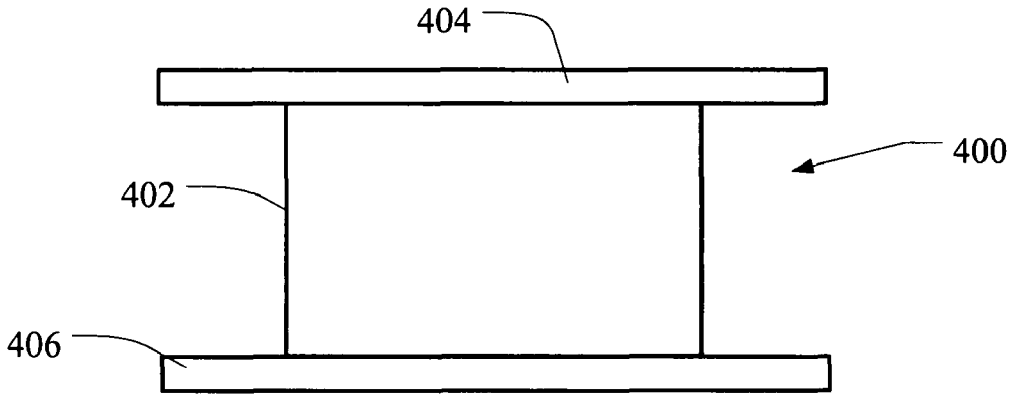
FIG. 4 is a perspective view of one embodiment of a lift device system.

Turning now to the drawings, FIG. 4 illustrates a lift device system 400, according to one embodiment, comprising a lifting mechanism 402 coupled with a platform 404 and a base 406. As used herein, the term "coupled with" means directly connected to or indirectly connected through one or more intermediate components. It can be appreciated that any suitable connection configuration allowing for movement along at least one single plane or axis may be used to couple the disclosed components together as will be described, such as, but not limited to, pin joints, sliding joints, hinges, ball and socket connectors, or a combination thereof. The lifting mechanism 402 is designed to actuate the platform 404 in a substantially linear manner, such that the platform 404 may remain parallel to the base 406 while in operation. The platform 404 may be coupled with an apparatus or device, or alternatively, incorporated into the apparatus or device. The base 406 may have rollers or casters (not shown) to move or position the lift device system 400. Alternatively, the base 406 may be coupled with another member, thereby fixing the position of the lift device system 400. It can be appreciated that the lift device system 400 may be mounted in a vertical position, a horizontal position, or a combination thereof, depending on the type of application. Moreover, more than one lifting mechanism 402 may be coupled with the platform 404 and the base 406, to provide increased lateral stability, rigidity, and/or load bearing capacity of the platform 404. Such a configuration is implementation dependent and may include more than one lifting mechanism 402 in a side by side or offset positions, and may share common components and/or coupling locations. Alternatively, where a single lifting mechanism 402 provides the requisite structural characteristics, e.g. lateral rigidity, a single mechanism may be used, centrally disposed, or offset between the base 406 and the platform 404. It will be appreciated that a single lift device mechanism 400, may include more than one lifting mechanisms 402 therein. The lifting mechanisms 402 may be stacked on top of one another in the same or alternate orientations. Such a configuration will allow the entire lifting mechanism 402 to reside within the platform 404 and the base 406.

The lift device system 400 may be used for various applications in the automotive, medical, home electrical, and general industries. For example, the lift device system 400 may be used to mount or displace computer display monitors, medical diagnostic equipment, or automotive diagnostic equipment.

Figure 5:
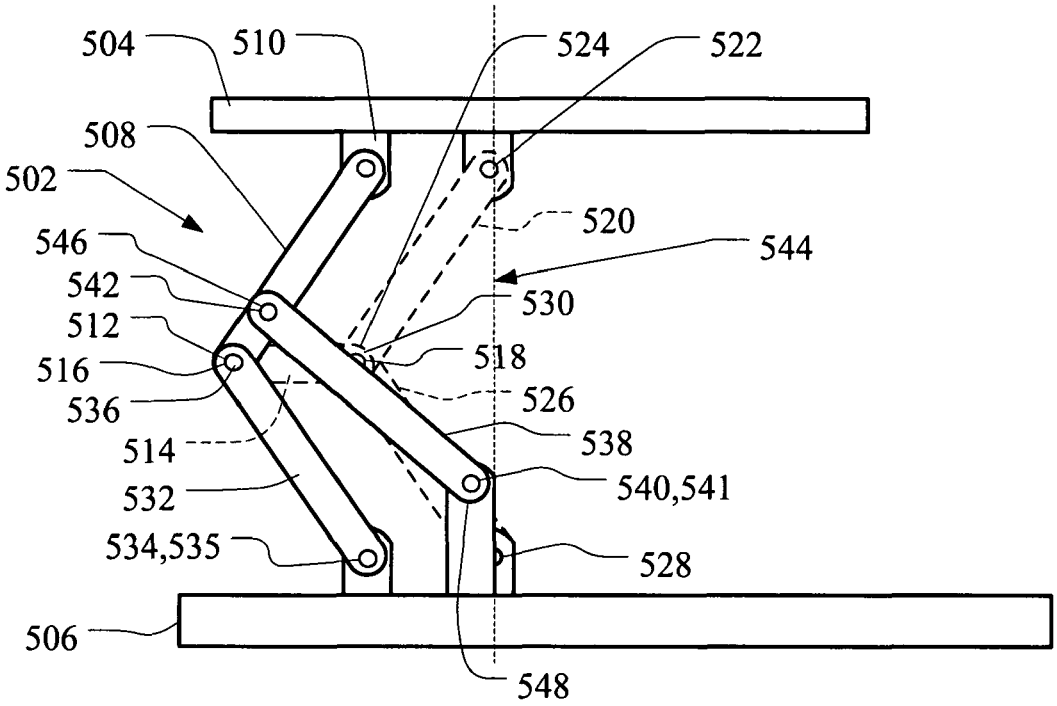
FIG. 5 is a perspective view of another embodiment of the lifting mechanism in FIG. 4.

One embodiment of the lifting device 400 is illustrated in FIG. 5. FIG. 5 illustrates a lifting mechanism 502 coupled with a platform 504 and a base 506. The lifting mechanism 502 comprises a first member 508 having a first 510 and second 512 ends, the first end 510 of the first member 508 is pivotally coupled with the platform 504. The second end 512 of the first member 508 is pivotally coupled with a second end 536 of a second member 532. A first end 534 of the second member 532 is pivotally coupled with the base 506 at a first point 535.

Pivotally coupled with the first member 508 is a connecting member 538 having a first 540 and second 542 ends. The first end 540 of the connecting member 538 is coupled with the base 506 at a second point 541, where the second point 541 is elevated above the first point 535. The second end 542 of the connecting member 538 is coupled with the first member 508 at a point 546 located between the first end 510 and the second end 512 of the first member 508.

To calculate the length and coupling location 548 of the first end 540 of the connecting member 538 as illustrated in FIG. 5, the coupling location 546 of the second end 542 of the connecting member 538 with the first member 508 is determined. The coupling location 546 is implementation dependent and will dictate, among other things, the trajectories of the first 508 and second 532 members and the platform 504, in addition to the structural characteristics of the lift mechanism 502. It can be appreciated that the coupling location 548 may be limited by the geometry of the link mechanism 502. Accordingly, the geometry of the link mechanism 502 is an additional consideration with regards to the placement of the coupling location 546 of the second end 542 of the connecting member 538.

Figure 6A:
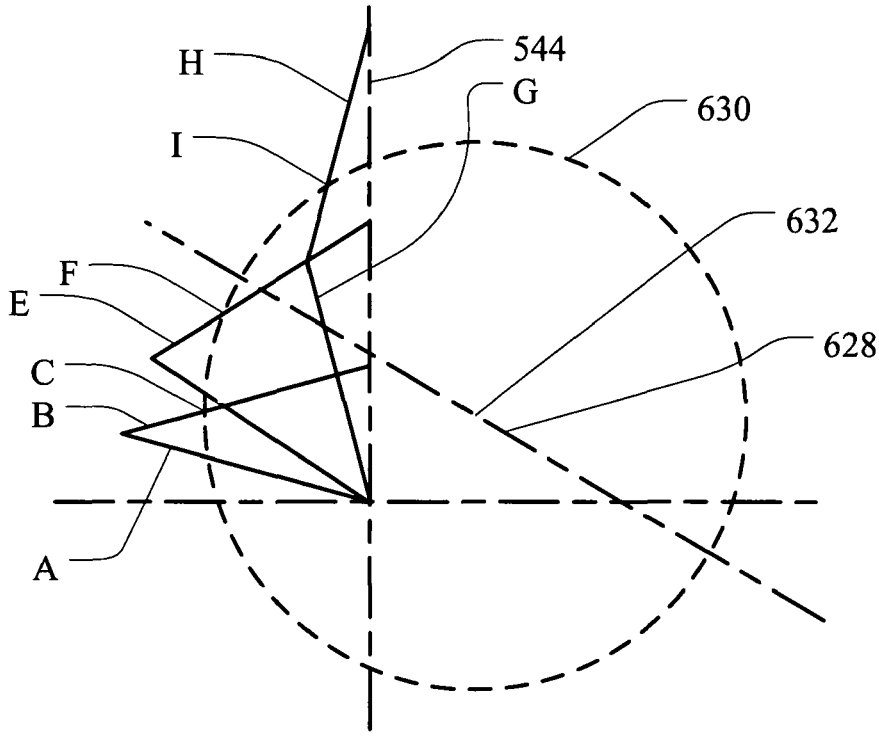
FIG. 6A is a plot of the trajectory of the lifting mechanism in FIG. 5 in a first, a second, and a third position.

Once the coupling location 546 is determined, a plot of the coupling location 546 of the second end 542 of the connecting member 536, the first member 508, and the second member 532, may be created for a first, second, and third positions, and is illustrated in FIG. 6A. The first, second, and third positions, as illustrated in FIGS. 6B, 6C, and 6D, respectively, are determined as the lifting mechanism 502 displaces the platform 504 in a substantially linear manner along a vertical axis 544.

Figure 6B:
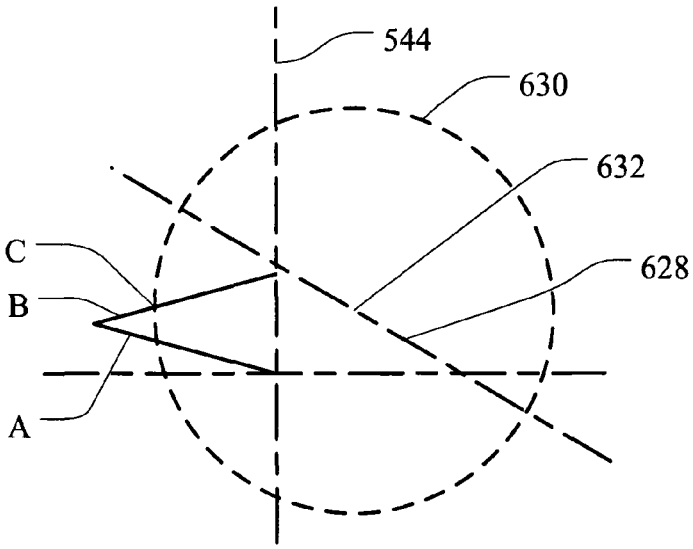
FIG. 6B is a plot of the trajectory of the lifting mechanism in FIG. 5. in the first position.
Figure 6C:
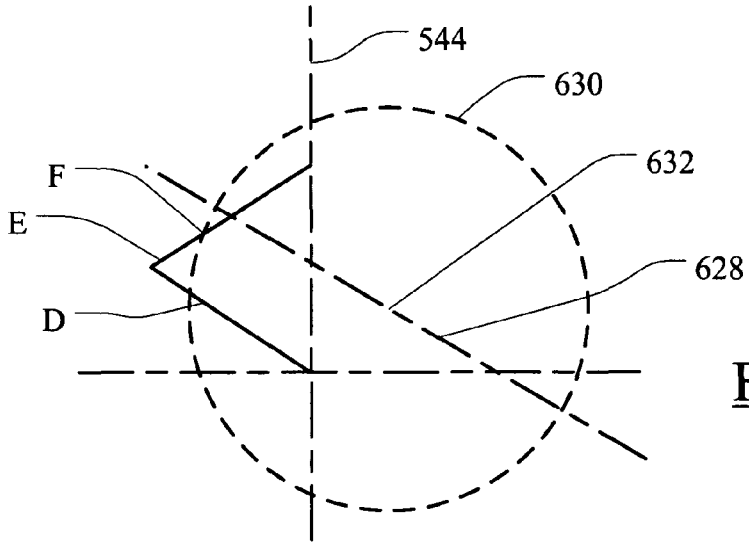
FIG. 6C is a plot of the trajectory of the lifting mechanism in FIG. 5 in the second position.
Figure 6D:
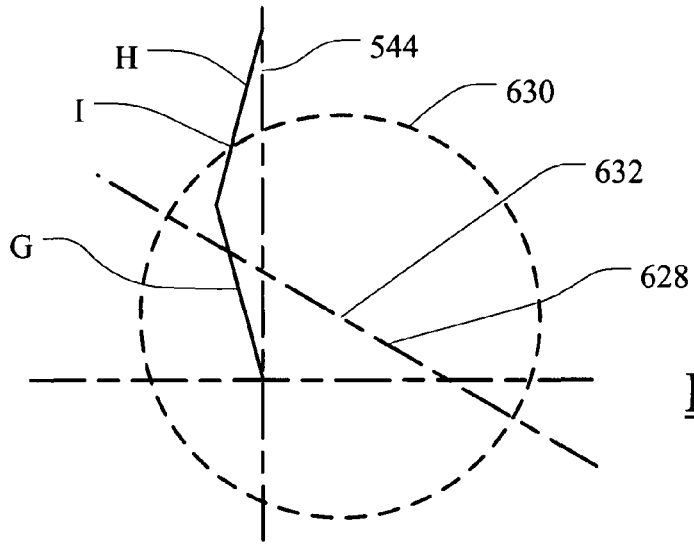
FIG. 6D is a plot of the trajectory of the lifting mechanism in FIG. 5 in the third position.

The first position, as further illustrated in FIG. 6B, depicts the second member 532 in a first position A and the first member 508 in a first position B. Point C denotes the chosen coupling location 546 of the second end 542 of the connecting member 538 in the first position. The second position, as further illustrated in FIG. 6C, shows the second member 532 in a second position D and the first member 508 in a second position E. Point F represents the coupling location 546 of the second end 542 of the connecting member 536. The third position, as further illustrated in FIG. 6D, shows the second member 532 in a third position G, the first member 508 in a third position H, and the coupling location 546 of the second end 542 of the connecting member 538 as point I on the first member 508.

Referring back to FIG. 6A, the trajectories of the first 508 and second 532 members may be plotted with respect to the coupling location 546 of the second end 542 of the connecting member 538 for all three positions. Next, a bisecting line 628 may be drawn between the points C and I, and a circle 630 with its center 632 along the bisecting line 628 is drawn. The center 632 and radius of the circle 630 is chosen such that the circle 630 intersects the coupling location 546 of the second end 542 of the connecting member 538, as indicated by points C, F, and I. The center 632 of the circle 630 is the coupling location of the first end 540 of the connecting member 538 with the base 506, while the radius of the circle 530 represents the length of the connecting member 538.

In operation, the lift device system 400 is actuated from a first position to a second position, thereby raising or lowering the platform 504. The actuation may be manual, automated/motorized, or a combination thereof. An actuation mechanism (not shown) may be provided and coupled at a suitable location to facilitate the movement of the system 400. By way of example and without limitation, the actuation means may be attached between the base 506 and the first member 508, the base 506 and the second member 532, or the base 506 and the connecting member 538. Alternatively, the actuation means may be attached between the first 508 and second 532 members, the first 508 and connecting 538 members, or the second 532 and connecting 538 members. Further, actuation assist mechanisms (not shown), such as springs, counterweights, hydraulic mechanisms or other force balancing mechanisms, may be provided which reduce the amount of force necessary to raise or lower the platform 504 or maintain the platform 504 in a particular position. The actuation assist mechanisms may be placed at specified coupling locations and act as a counter-weight to an apparatus placed on, or incorporated into, the platform 504. The amount of force provided by the actuation assist mechanism may be fixed or variable and is implementation dependent. For example, the amount of force may vary based on the weight of the apparatus and/or platform 504 and position/configuration of the connection of the actuation assist mechanism. The members move substantially simultaneously during operation, and the connecting member 538 is rotated in an arcuate motion with respect to the first member 508 and the base 506. The arcuate motion of the connecting member 538 confines the trajectory of the first member 508. The second member 532 is pivotally coupled with the first member 508 and therefore rotates according to the trajectory of the first member 508. The resulting overall trajectory causes the first end 510 of the first 508 member to actuate the platform 504 in a substantially linear manner with respect to the vertical axis 544 to a second position. The lift device system 400 may return to a first position from the second position, however it can be appreciated that the platform 504 may be positioned anywhere in between the first and second positions. A locking device, force balancing device or the like (not shown) may also be incorporated into the lifting mechanism 502 to fix the platform 504 in a position between the first and second positions (not shown).

It can be appreciated that the lifting mechanism 502 may further comprise additional members to secure the platform 504 in a position substantially parallel to the base 506 and substantially maintain this orientation throughout the range of motion of the device 400. Alternatively, mechanisms may be provided to alter the orientation of the platform 504 over the range of motion, such as to tilt the platform 504 as it elevates. Such a configuration may be implementation dependent, however, and by way of illustration, an example of an embodiment is provided. A third 526, fourth 520, and shared 514 members, as illustrated in FIG. 5, allow for improved structural characteristics of the lift mechanism 502 and for the platform 504 to remain parallel with the base 506 in operation. In this embodiment, a first end 516 of the shared member 514 is pivotally coupled to the second ends 512, 536 of the first 508 and second 532 members. A second end 518 of the shared member 514 is pivotally coupled to a second end 530 of the third member 526 and a second end 524 of the fourth 520 member. A first end 528 of the third member 524 may be pivotally coupled to the base 506 at a point on the same plane as the first end 534 of the second member 532. A first end 522 of the fourth member 520 may be pivotally coupled to the platform 504 at a point on the same plane as the first end 510 of the first member 508.

It can be appreciated that the second end 542 of the connecting member 538 may be coupled, alternatively, to the fourth member 529. To plot the trajectories of the lift device system 400 and calculate the length and coupling location of the connecting member 538, the third member 526 and the fourth member 520 would be used instead of the first 508 and second members 532; the remainder of the calculation would remain substantially identical as described above.

In operation, the shared member 514 is pivotally coupled to the first member 508 and therefore rotates according to the trajectory of the first member 508. The confined trajectory of the first member 508 is translated to the third 526 and fourth 520 members via the shared member 514. The resulting overall trajectory remains substantially the same as detailed above, and causes the first ends 510, 522 of the first 508 and fourth 520 members to actuate the platform 504 in a substantially linear manner with respect to the vertical axis 544, thereby allowing the platform 504 to remain parallel to the base 506 in the second position. It will be appreciated that in this embodiment that the first member 508 is parallel to the fourth member 520 and the second member 532 is parallel to the third member 526.

Figure 7:
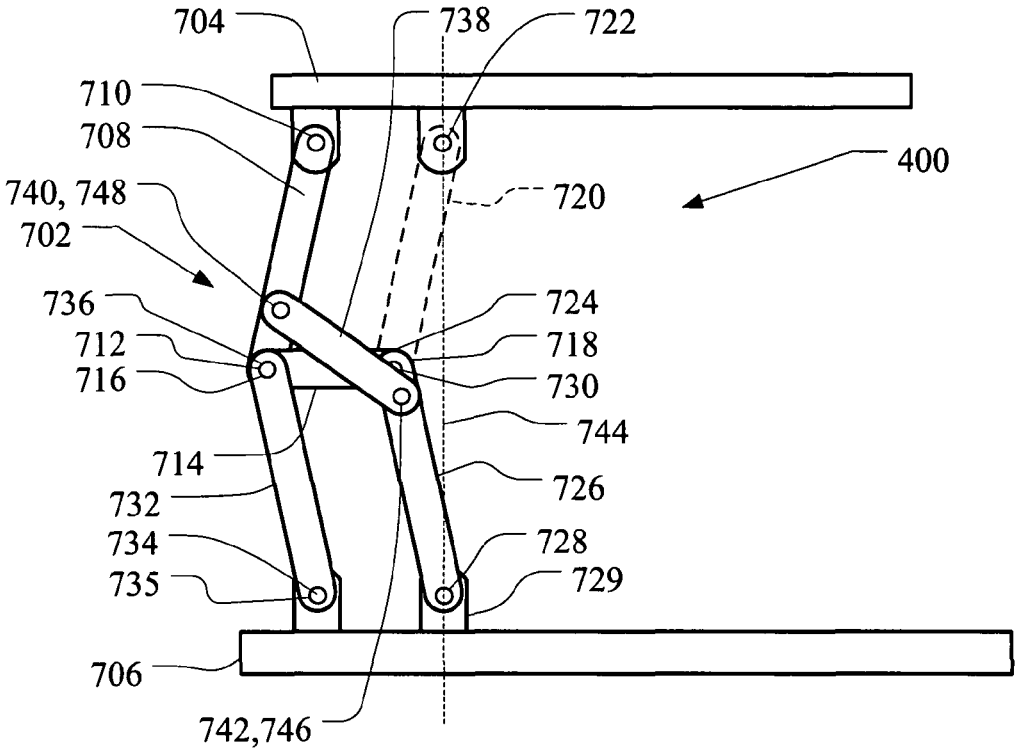
FIG. 7 is a perspective view of yet another embodiment of the lifting mechanism in FIG. 4

Another embodiment of the lifting mechanism 402 is shown in FIG. 7. FIG. 7 illustrates the lift device system 400 having a lift device mechanism 702 coupled with a platform 704 and a base 706. The lifting mechanism 702 comprises a first member 708 having a first end 710 and a second end 712, where the second end 712 of the first member 708 is pivotally coupled with a first end 716 of a shared member 714 and a second end 736 of a second member 732. A second end 718 of the shared member 714 is pivotally coupled with a second end 730 of a third member 726. A first end 728 of the third member 726 is pivotally coupled with the base at a first point 729. A first end 734 of the second member 732 is pivotally coupled with the base 706 at a second point 735, where the first point 729 is elevated above the second point 735. The first end 710 of the first member 708 is pivotally coupled with the platform 704. A first end 740 of a connecting member 738 is pivotally coupled between the first 710 and second 712 ends of the first member 708. A second end 742 of the connecting member 738 is pivotally coupled between the first 728 and second 730 ends of the third member 726.

Figure 8A:
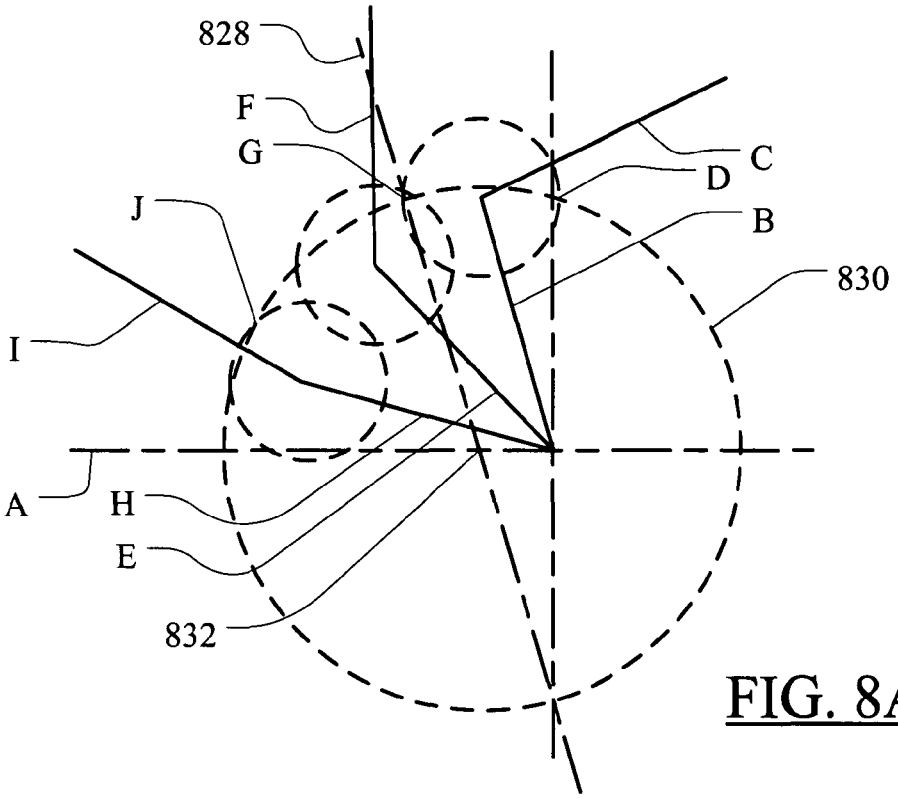
FIG. 8A is a plot of the trajectory of the lifting mechanism in FIG. 7 in a first, a second, and a third position.

To calculate the length and coupling location 748 of the connecting member 738 of the lift mechanism 702 as illustrated in FIG. 7, the coupling location 746 of the second end 742 of the connecting member 738 with the third member 726 is determined first. The coupling location 746 of the second end 742 of the connecting member 738 is implementation dependent, and will be chosen after considering the desired structural and performance characteristics of the lift device system 400, as explained above in relation to the first embodiment. Once the coupling location 746 is chosen, a plot of the trajectory of the third member 726, shared member 714, and coupling location 746 of the second end 742 of the connecting member 742, in a first, second, and third position is determined with respect to the first member 708. The plot is illustrated in FIG. 8A.

Figure 8B:
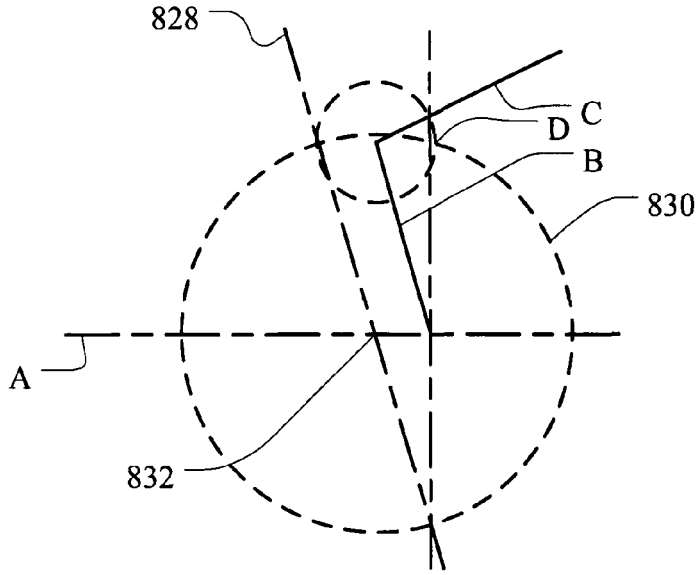
FIG. 8B is a plot of the trajectory of the lifting mechanism in FIG. 7 in the first position.
Figure 8C:
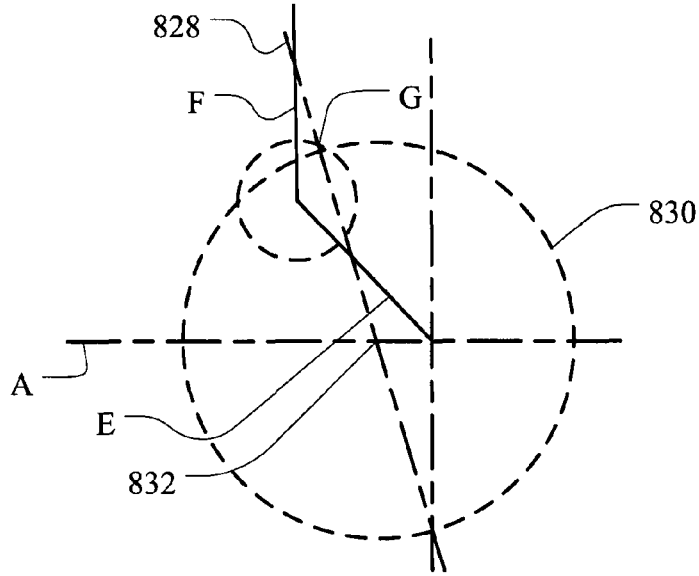
FIG. 8C is a plot of the trajectory of the lifting mechanism in FIG. 7 in the second position.
Figure 8D:
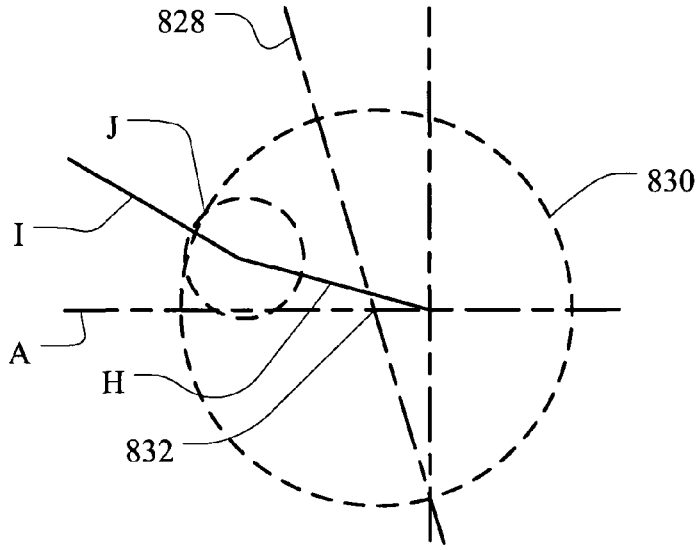
FIG. 8D is a plot of the trajectory of the lifting mechanism in FIG. 7 in the third position.

The first position, shown in further detail in FIG. 8B, illustrates the first member 708 in the fixed position A, the shared member 714 in a first position B, and the third member 726 in a first position C. Point D denotes the chosen coupling location 746 of the second end 742 of the connecting member 738 with respect to the third member 726 in a first position. The second position, as shown in FIG. 8C, again illustrates the first member 708 in the fixed position A, the shared member 714 in a second position E and the third member 726 in a second position F. Point G denotes the coupling location 746 of the second end 742 of the connecting member 738 with respect to the third member 726 in a second position. FIG. 8D illustrates the third and final position of the lifting mechanism 702. Again, the first member 708 is in position A, the connecting member 738 is now in a third position H, and the third member 726 is in a third position I. Point J denotes the coupling location 746 of the second end 742 of the connecting member 738 in a third position with respect to the third member 726.

Turning back to FIG. 8A, once the three positions are plotted, a bisecting line 828 may be drawn between points D and J. The intersection of the bisecting line 828 and the first member 708 denotes the coupling location 748 of the first end 740 of the connecting member 738 with the first member 708. The distance between the coupling location 748 of the first end 740 of the connecting member 738 and any of the points D, G, or J represents the length of the connecting member 738.

Alternatively, a circle 830 may be drawn through the points D, G, and J having a center 832 along the bisecting line 828. The center of the circle 832 would denote the coupling location 748 of the first end 740 of the connecting member 738 with the first member 708. The radius of the circle 830 would be equal to the length of the connecting member 738.

In operation, the lift device system 400 is actuated from a first position to a second position. The actuation may be manual, automated, or a combination thereof, and may include mechanisms to assist the actuation as was described above in relation to the first embodiment. The members move substantially simultaneously during operation. The trajectory of the connecting member 738 allows the platform 704 to travel in a substantially linear fashion. The connecting member 738 is rotated in a generally arcuate motion with respect to the first 708 and third 726 members, and therefore the trajectories of the first 708 and third 726 members are confined to the arcuate trajectory of the connecting member 738. The trajectory of the first 708 and third 726 members is translated to the second 732 member via the shared member 714. The trajectory of the first end 710 of the first member 708 displaces the platform 704 in linear fashion to a second position. During operation, the platform 704 travels along a vertical axis 744. Moreover, it will be appreciated that during operation the third member 726 remains parallel to the second member 732. The lift device system 400 is operative to return to a first position from the second position. However, it can be appreciated that the platform 704 may be positioned anywhere in between the first and second positions. Again, a locking device (not shown) may also be incorporated into the lifting mechanism 702 to fix the platform 704 in a position between the first and second positions.

It can be appreciated that the lifting mechanism 702 may further comprise additional members to secure the platform 704 in a position substantially parallel to the base 706 and substantially maintain this orientation throughout the range of movement of the device 400. Alternatively, mechanisms may be provided to alter the orientation of the platform 704 over the range of motion, such as to tilt the platform 704 as it elevates. Such a configuration may be implementation dependent, however, and by way of illustration, an example of an embodiment is provided. A fourth member 720, having a first 722 and second 724 ends as illustrated in FIG. 7, allows for improved structural characteristics of the lift mechanism 702. It can be appreciated that an alternative structural configuration may be implemented to allow for the platform 704 to remain parallel with the base 706 in operation. In this embodiment, the first end 722 of the fourth member 720 is pivotally coupled with the platform 704 at a point along the same plane as the first end 710 of the first member 708. The second end 724 of the fourth member 720 is pivotally coupled with the second end 718 of the shared member 714 and the second end 730 of the third member 726.

It can be appreciated that the first end 740 of the connecting member 728 may be coupled between the first 722 and second 724 ends of the fourth member 720 and the second end 742 of the connecting member 738 may be coupled between the first 734 and second 736 ends of the second member 732.

The method of calculating the length and coupling location of the connecting member 738 would change so far as the trajectory of the fourth 720, shared 714, and second 732 members and the coupling location 748 of the first end 740 of the connecting member 738 with respect to the second member 732 would be plotted. The remainder of the calculation would remain unchanged.

In operation, the trajectory of the connecting member 738 confines the trajectory of the first 708 and third 726 members. The trajectory of the first 708 and third 726 members is translated to the fourth member 720 via the shared member 714. The trajectory of the first ends 710, 722 of the first 708 and fourth 720 members displace the platform in a linear fashion to the second position. During operation, the platform 704 remains parallel with the base 706 and travels along the vertical axis 744. It will be appreciated that the first member 708 remains substantially parallel with the fourth member 720, and the second member 732 remains substantially parallel with the third member 726 in operation.

Figure 9A:
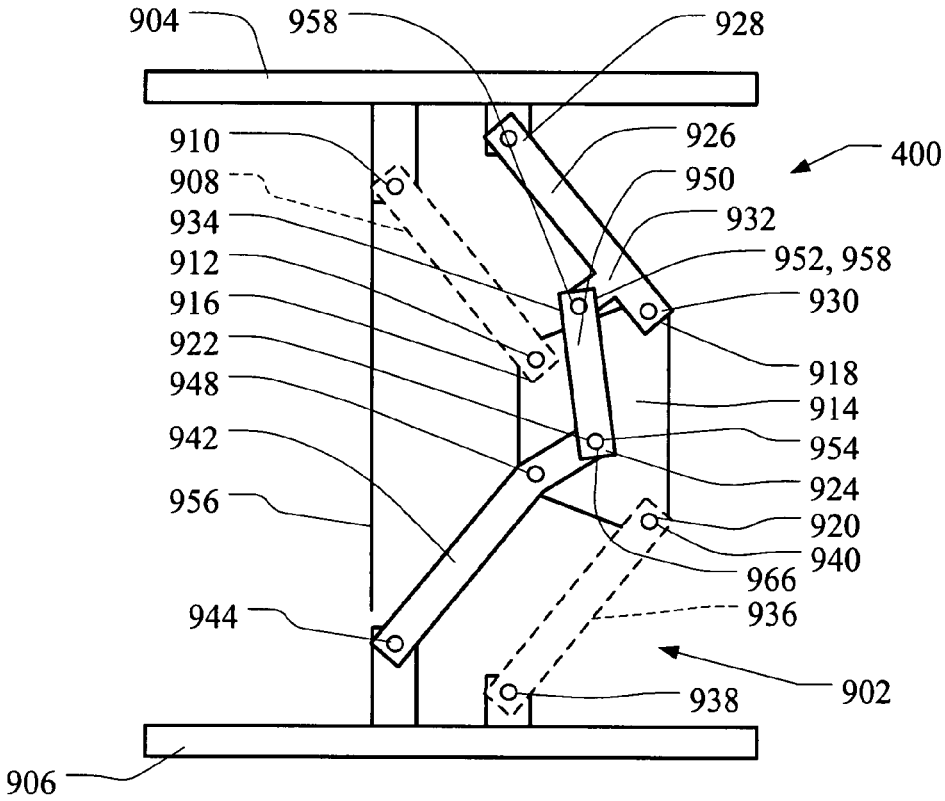
FIG. 9A is a perspective view of yet another embodiment of the lifting mechanism in FIG. 4.
Figure 9B:
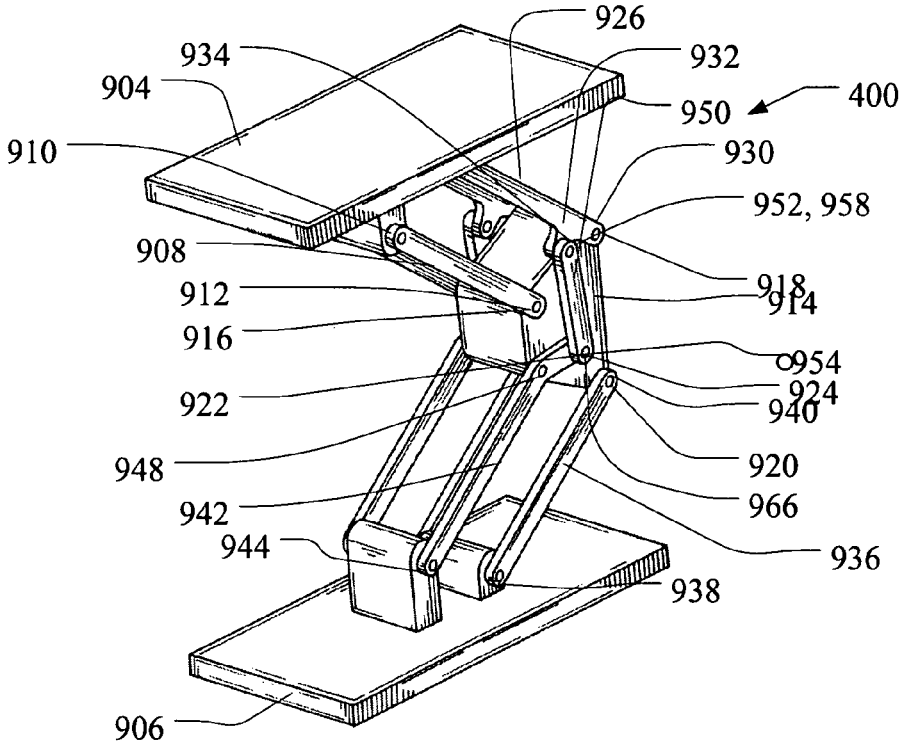
FIG. 9B is a perspective view of yet another embodiment of the lifting mechanism in FIG. 4.

Another embodiment of the lifting mechanism 402 is shown in FIG. 9A. FIG. 9A illustrates the lift device system 400 having the lift device mechanism 902 coupled with the platform 904 and the base 906. FIG. 9B is one embodiment of the lift device system 400 of FIG. 9A where two lifting mechanisms 902 are positioned parallel to each other. As illustrated in FIGS. 9A and 9B, the lift device mechanism 902 comprises a first member 942 having a first end 944 and a second end 946, a second member 926 having a first end 928 and a second end 930, a connecting member 950 having a first end 952 and a second end 954, and a shared member 914 having a first 922 and second 918 coupling locations. In the exemplary embodiment, the shared member 914 is implemented as a plate having a substantially trapezoidal shape wherein the coupling locations are located at the vertices of the edges. It can be appreciated that the shared member 914 may be of other shapes so long as the respective coupling locations and relative orientation of the other members are suitably implemented as described. The first end 944 of the first member 942 is pivotally coupled with the base 906 at a first point. The first end 928 of the second member 926 is pivotally coupled with the platform 904 at a second point. The second end 930 of the second member 926 is pivotally coupled with the second coupling location 918 of the shared member 914. The second member 926 further comprises a T-shaped extension 932 having a first end 934, and is located between the first end 928 and second end 930 of the second member 926. The second end 946 of the first member 942 is pivotally coupled with the first coupling location 922 of the shared member 914. The first member 942 further comprises a coupling point 948 between the first end 944 and the second end 946 that is pivotally coupled with the shared member 914. The coupling point 948 is collinear with the first end 944 of the first member 942 and with the second end 946 of the first member 942. However, the first end 944 and the second end 946 of the first member 942 are not collinear with each other, and are offset at a position dependent on a coupling location 966 of the second end 954 of the connecting member 950. The coupling location 966 of the connecting member 950 will be discussed in detail below. The first end 952 of the connecting member 950 is pivotally coupled with the first end 934 of the T-shaped extension 932 of the second member 926, and the second end 954 of the connecting member 950 is pivotally coupled with the second end 946 of the first member 942.

Figure 9C:
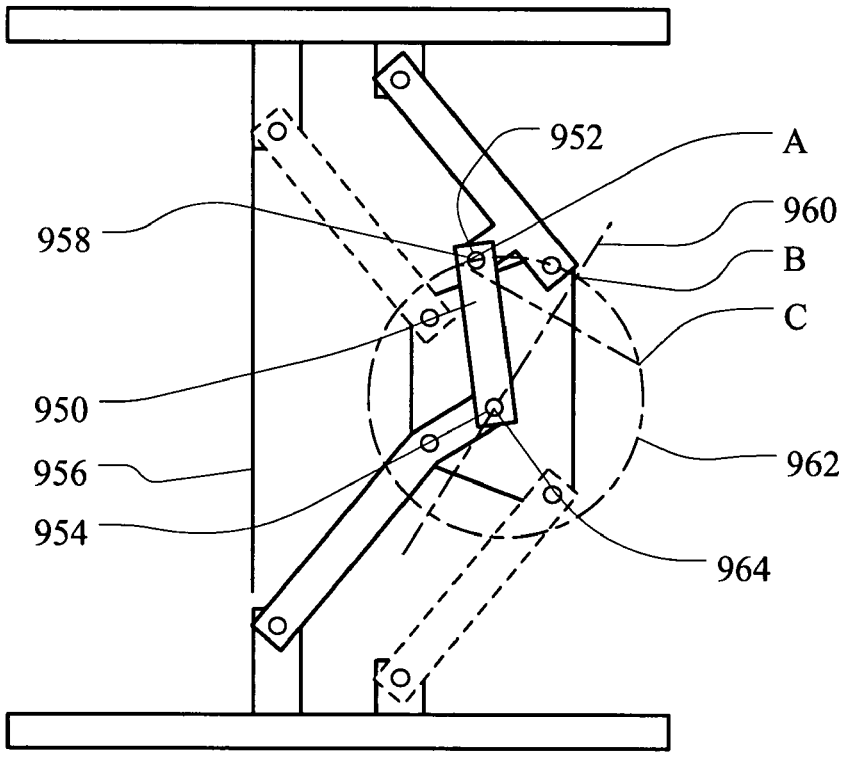
FIG. 9C is a plot of the trajectory of the lifting mechanism in FIG. 9A.
Figure 10:
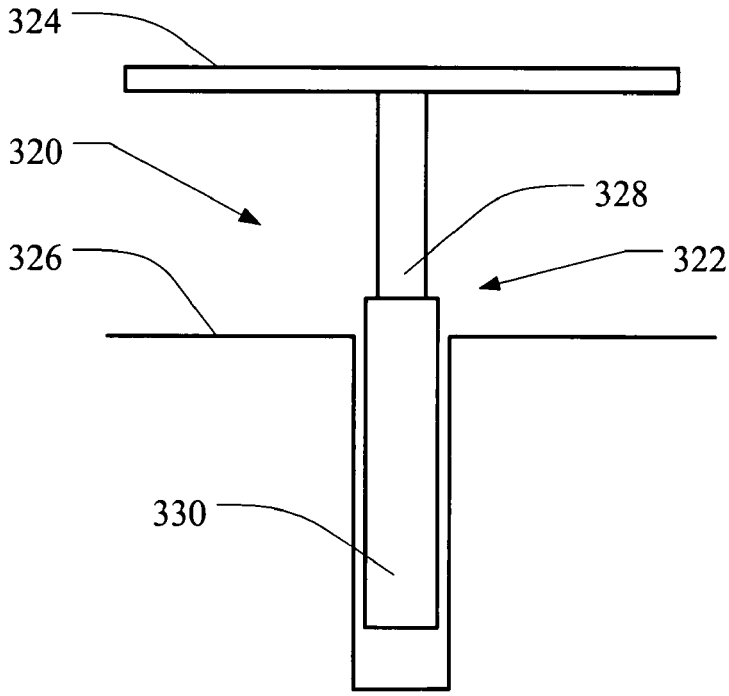
FIG. 10 (Prior Art)
FIG. 10 is a perspective view of yet another conventional lift device system.

In calculating the length and the coupling location 966 of the connecting member 950 of the lift mechanism 902 as illustrated in FIG. 9A, the coupling location 958 of the first end 952 of the connecting member 950 with the second member 926 is chosen. The coupling location 958 is chosen based on the desired trajectory and implementation of the lift device system 400, pursuant to similar considerations described above with regard to the first embodiment. Once the coupling location 958 is chosen, a plot is created of the trajectory of the first member 942, the second member 926, the shared member 914, and the coupling location 958 of the connecting member 950. The trajectories of the members are plotted with respect to the displacement of the platform 904 along a vertical axis 956. FIG. 9C illustrates the trajectory of the lift mechanism 902 in a first, second, and third position. Point A is associated with the coupling location 958 of the first end 952 of the connecting member 950 in the first position. Point B is the coupling location 958 of the first end 952 of the connecting member 950 in the second position. Point C is the coupling location 958 of the first end 952 of the connecting member 950 in the third position. The positions are determined while the platform is actuated in a linear fashion along a vertical axis 956.

Once the points A, B, and C are determined, a bisecting line 960 is drawn between points A and C. A circle 962 is then constructed with the center of the circle 962 disposed on the bisecting line 960, such that points A, B, and C lie on the periphery of the circle 962. The center of the circle 962 denotes the coupling location 966 of the second end 954 of the connecting member 950 with the second end 946 of the first member 942. The length of the connecting member 950 is equal to the radius of the circle 962.

In operation, the members move substantially simultaneously, and the trajectory of the first member 942 confines the trajectory of the shared 914 and connecting 950 members. The connecting member 950 confines the trajectory of the second member 926, and as a result, the first end 928 of the second 926 member is actuated such that the platform 904 travels in a linear fashion with respect to the vertical axis 956 to a second position. The lift device system 400 may return to a first position from the second position. It can be appreciated that the platform 904 may be positioned anywhere in between the first and second position and the lifting mechanism 902 may incorporate a lock (not shown) for fix the position of the platform 904 in a desired position.

It can be appreciated that the lifting mechanism 902 may further comprise additional members to secure the platform 904 in a position substantially parallel to the base 906 and maintain this orientation during operation. Such a configuration may be implementation dependent, however, and by way of illustration, an example of an embodiment is provided. A third 936 and fourth 908 members, having a first 938, 910 and second 940, 912 ends as illustrated in FIG. 9A, allows for improved structural characteristics of the lift mechanism 902 and allows for the platform 904 to be parallel to the base 906 in operation. In this embodiment, the second end 912 of the fourth member 908 is pivotally coupled with the shared member 914 at a fourth coupling location 916. The first end 910 of the fourth member is pivotally coupled with the platform 904 at a fourth point, which is below the second point. The first end 938 of the third member 936 is pivotally coupled with the base 906 at a third point, which is below the first point. The second end 940 of the third member 936 is pivotally coupled with the shared member 914 at a third coupling location 920. It can be appreciated that the connecting member 950 may be coupled with the third 936 and fourth 908 members instead of the first 942 and second 926 members. The fourth member 908 would have the same geometry as the first member 942, and the third member 936 would have the same geometry as the second member 926, and vice versa.

If the connecting member 950 is pivotally coupled with the third 936 and fourth 908 members, it can be appreciated that the coupling location 958 and length of the connecting member 950 may be determined using the same calculations as described above by plotting the trajectory of the third 936, fourth 908, and connecting 950 members instead.

In operation, the trajectory of the connecting member 950 confines the trajectory of the first 942 and second 926 members. The trajectory of the first 942 and second 926 members is translated to the third 936 and fourth 908 members via the shared member 914. As a result, the first ends 928, 910, of the second 926 and fourth 908 members are actuated such that the platform 904 travels in a linear fashion with respect to the vertical axis 956 and remains parallel with the base 906. In this embodiment, during operation, the first member 942 remains substantially parallel with the third member 936, and the second member 926 remains substantially parallel with the fourth member 908.

While the invention has been illustrated and described in detail in the drawings and foregoing description, the same is to be considered as illustrative and not restrictive in character, it being understood that only exemplary embodiments have been shown and described and do not limit the scope of the invention in any manner. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

We claim:

1. A lift device system for use in displacing a load in a substantially linear manner, the lift device system comprising:

a platform;

a base;

a lifting mechanism coupled with the platform and the base, the lifting mechanism comprising:

a first member having first and second ends, where the first end of the first member is pivotally coupled with the platform;

a second member, having first and second ends, where the first end of the second member is pivotally coupled with the base, at a first point, and the second end is directly and pivotally coupled with the second end of the first member at a connector joint;

a connecting member having first and second ends, wherein the first end of the connecting member is pivotally coupled with the base at a second point, where the second point is above the first point, and the second end of the connecting member is pivotally coupled with first member;

a shared member, having first and second ends, where the first end of the shared member is pivotally coupled with the second end of the first member and the second end of the second member; and a third member having first and second ends, where the first end of the third member is pivotally coupled with the base, and the second end of the third member is pivotally coupled with the second end of the shared member.

2. The lift device system of claim 1, further comprising a fourth member having first and second ends, where the first end of the fourth member is pivotally coupled with the platform, and the second end of the fourth member is pivotally coupled with the second end of the shared member.

3. The lift device system of claim 2, wherein the second ends of the first, second, third, and fourth members are pivotally coupled on a same plane.

4. The lift device system of claim 2, wherein the first member is parallel to the fourth member.

5. The lift device system of claim 4 wherein the second member is parallel to the third member.

6. The lift device system of claim 5, wherein the platform is substantially parallel to the base.

7. The lift device system of claim 6, wherein the first ends of the first and fourth members pivotally coupled with the platform share a same plane.

8. The lift device system of claim 6, wherein the first ends of the second and third members pivotally coupled with the base share a same plane.

9. A lift device system for use in displacing a load in a substantially linear manner, the lift device system comprising:

a platform;

a base;

a lifting mechanism coupled with the platform and the base, the lifting mechanism comprising:

a first member having first and second ends, where the first end of the first member is pivotally coupled with the platform;

a second member, having first and second ends, where the first end of the second member is pivotally coupled with the base, at a first point, and the second end is pivotally coupled with the second end of the first member;

a connecting member having first and second ends, wherein the first end of the connecting member is pivotally coupled with the base at a second point, where the second point is above the first point, and the second end of the connecting member is pivotally coupled with first member;

a shared member, having first and second ends, where the first end of the shared member is pivotally coupled with the second end of the first member and the second end of the second member; and a third member having first and second ends, where the first end of the third member is pivotally coupled with the base, and the second end of the third member is pivotally coupled with the second end of the shared member.

10. The lift device system of claim 9, further comprising a fourth member having first and second ends, where the first end of the fourth member is pivotally coupled with the platform, and the second end of the fourth member is pivotally coupled with the second end of the shared member.

11. The lift device system of claim 10, wherein the second ends of the first, second, third, and fourth members are pivotally coupled on a same plane.

12. The lift device system of claim 10, wherein the first member is parallel to the fourth member.

13. The lift device system of claim 10, wherein the first ends of the first and fourth members pivotally coupled with the platform share a same plane.

14. The lift device system of claim 9, wherein the second member is parallel to the third member.

15. The lift device system of claim 9, wherein the platform is substantially parallel to the base.

16. The lift device system of claim 9, wherein the first ends of the second and third members pivotally coupled with the base share a same plane.

* * * * *